United States Patent [19]

Yu

[11] Patent Number: 4,470,218

[45] Date of Patent: Sep. 11, 1984

[54] TOY BALLOON

[76] Inventor: Kuo-Liang Yu, No. 7, Ta-Feng Rd., Anli Village, Shenkang Hisang, Taichung, Taiwan

[21] Appl. No.: 533,788

[22] Filed: Sep. 19, 1983

[51] Int. Cl.[3] ..... A63H 3/06

[52] U.S. Cl. ..... 446/220

[58] Field of Search ..... 46/87, 88, 89, 90, 178; 128/132 R

[56] References Cited

U.S. PATENT DOCUMENTS 1,714,558 5/1929 Hauff ..... 46/87

2,436,684 2/1948 Annis ..... 46/89 X 2,449,147 9/1948 Samuels ..... 46/90

2,577,345 12/1951 McEwen ..... 128/132 R

*Primary Examiner*—Mickey Yu

[57] ABSTRACT

A toy balloon which can be shot out accompanying a noise by the thrust developed during the expelling of the charged air when the inflated balloon is released from restraining, including an envelope with profile shaped to have minimum resistance to the air and an integral inflating mouth having thinner wall than other portions.

1 Claim, 1 Drawing Figure

TOY BALLOON

BACKGROUND OF THE INVENTION

The present invention relates to a balloon and particularly to an improved whistle balloon.

A toy balloon is commonly provided with a flange around the mouth through which the air being blown into. Thus, owing to the fact that the wall of the edge portion is thickened, it will not be vibrated by the expelled air as the inflated balloon being released. Consequently, the conventional whistle ballon is available only in the type that further mounted with a sound device therein to accomplish the desired sound-making function. The provision of this additional device will entail an extra cost of material and labour in manufacture.

SUMMARY OF THE INVENTION

Accordingly, it is a main object of the present invention to provide an improved balloon which produces a noise when being released without further provision of sound device.

In accordance with the present invention, an improved balloon comprises a first inflatable envelope section having a round tip; and an integrally formed second inflatable tubular section having an opening provided at one end thereof for blowing therefrom, the second section having a uniform thickness less than which of the first section.

According to a further feature of the invention, the first section including a fusiform forward portion and a middle portion which defining a larger volume than which of the forward portion when said middle and said forward portion are inflated, the middle portion being progressively reduced in transverse dimension thereof in a direction remote from the forward portion to join with the second section.

DETAILED DESCRIPTION OF THE PREFERRED EMBODIMENT

Figure 1:
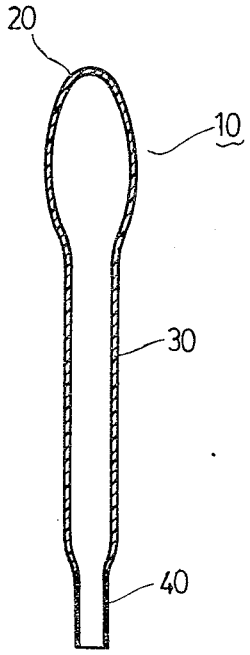
FIG. 1 is a longitudinal section view illustrating one preferred embodiment of the present invention.

Referring to FIG. 1, reference number 10 designates a jet type balloon which includes a inflatable envelope of rubber, formed into a shape with least aerodynamical resistance.

Specifically, the balloon 10 comprises three sections in connection which differ from one another in the shape in order to obtain most advantageous conditions for the projection of the inflated balloon through the air by the reaction of backward discharging air.

As shown in FIG. 1, a portion 20 which is convergent toward two ends positioned in front of a cylindrical portion 30, the latter is smoothly contiguous the preceding portion and having a substantially constant diameter through the length thereof, which, in this embodiment, is corresponding to the smallest diameter of the preceding portion. The wall of the two portions are formed with the same thickness.

Cylindrical portion 30 is followed by a shrinked neck portion 40 which is opened at one end for air inflating and discharging, on the other hand, it also acts as a sound-making device. It is noted that the neck portion 40 is formed with a thinner wall.

With the structure indicated above, when the inflated balloon 10 is released from the player's hand it will be shot out accompanying a noise caused by the vibration of air column formed during the discharging of air.

While the invention has been described in connection with what is presently considered to be the most practical and preferred embodiment, it is to be understood that the inventions is not to be limited to the disclosed embodiments but on the contrary, it intended to cover various modifications and equivalent arrangements included within the spirit and scope of the appended claims which scope is to be accorded the broadest interpretation so as to encompass all such modifications and equivalent structures.

I claim:

1. A balloon comprising:

(a) a first inflatable section having a fusiform forward portion and a tubular rear portion whereby the balloon is propelled in a generally forward direction during expulsion of air from the first section; and (b) a second inflatable section of cylindrical shape integrally connected at its one end to the tubular portion of the first inflatable section and open to atmosphere at its other end, the thickness of the wall of the second section being less than that of the first section whereby air passing through the second section from the first section causes the walls of the second section to vibrate and produce a sound.

* * * * *